US011235376B2

(12) United States Patent
Federhen et al.

(10) Patent No.: US 11,235,376 B2
(45) Date of Patent: Feb. 1, 2022

(54) METHOD AND DEVICE FOR REGENERATING FOUNDRY SAND

(71) Applicant: Klein Anlagenbau AG, Niederfischbach (DE)

(72) Inventors: Bernd Federhen, Siegen (DE); Markus Jendrock, Niederfischbach (DE); Enno Schulte, Siegen (DE)

(73) Assignee: Klein Anlagenbau AG, Niederfischbach (DE)

( * ) Notice: Subject to any disclaimer, the term of this patent is extended or adjusted under 35 U.S.C. 154(b) by 479 days.

(21) Appl. No.: 16/076,140

(22) PCT Filed: Dec. 7, 2016

(86) PCT No.: PCT/EP2016/080145

§ 371 (c)(1),
(2) Date: Aug. 7, 2018

(87) PCT Pub. No.: WO2017/137113

PCT Pub. Date: Aug. 17, 2017

(65) Prior Publication Data

US 2019/0351479 A1 Nov. 21, 2019

(30) Foreign Application Priority Data

Feb. 8, 2016 (EP) ..... 16154654

(51) Int. Cl.
*B22C 5/18* (2006.01)
*B22C 5/06* (2006.01)
(Continued)

(52) U.S. Cl.
CPC ..... *B22C 5/185* (2013.01); *B22C 5/06* (2013.01); *B22C 5/08* (2013.01); *B22C 5/10* (2013.01)

(58) Field of Classification Search
CPC .. B22C 5/185; B22C 5/06; B22C 5/08; B22C 5/10; B22C 5/0409; B22C 5/04
See application file for complete search history.

(56) References Cited

U.S. PATENT DOCUMENTS 6,000,644 A * 12/1999 Musschoot ..... B22C 5/08 164/5

FOREIGN PATENT DOCUMENTS

CN 1244824 A 2/2000
CN 103769531 A 5/2014
(Continued)

OTHER PUBLICATIONS

International search report for patent application No. PCT/EP2016/080145 dated Feb. 23, 2017.

*Primary Examiner* — Kevin P Kerns
*Assistant Examiner* — Steven S Ha
(74) *Attorney, Agent, or Firm* — Bachman and Lapointe PC; George Coury

(57) ABSTRACT

A method for regenerating foundry sand, in particular for the renewed production of foundry molds and/or foundry mold cores from the regenerated foundry sand, through removal of binding agent, from a foundry sand/binding agent mixture, using a solid support means (6), wherein binding agent and support means (6) are separated from the foundry sand, wherein support means (6) is brought into contact with the foundry sand/binding agent mixture, is preferably added to it, and, together with the binding agent, which adheres thereto and/or which is incorporated therein, is separated from the foundry sand (10).

11 Claims, 1 Drawing Sheet

(51) Int. Cl.
*B22C 5/08* (2006.01)
*B22C 5/10* (2006.01)

(56) References Cited

FOREIGN PATENT DOCUMENTS

| | | | | | |
|---|---|---|---|---|---|
| DE | 2404702 | B1 | | 4/1975 | |
| DE | 2408981 | A1 | | 9/1975 | |
| DE | 2705606 | A1 | | 8/1978 | |
| DE | 4306007 | A1 | | 9/1994 | |
| DE | 4316610 | A1 | | 11/1994 | |
| DE | 10038419 | A1 | | 2/2002 | |
| DE | 102005029742 | B3 | | 8/2006 | |
| DE | 202008018001 | U1 | | 4/2011 | |
| DE | 102013001801 | B4 | * | 12/2014 | ..... B22C 5/0463 |
| EP | 0336533 | A2 | | 10/1989 | |
| WO | 9822240 | A1 | | 5/1998 | |
| WO | WO-2005107975 | A1 | * | 11/2005 | ..... B22C 9/02 |
| WO | 2013026579 | A1 | | 2/2013 | |

* cited by examiner

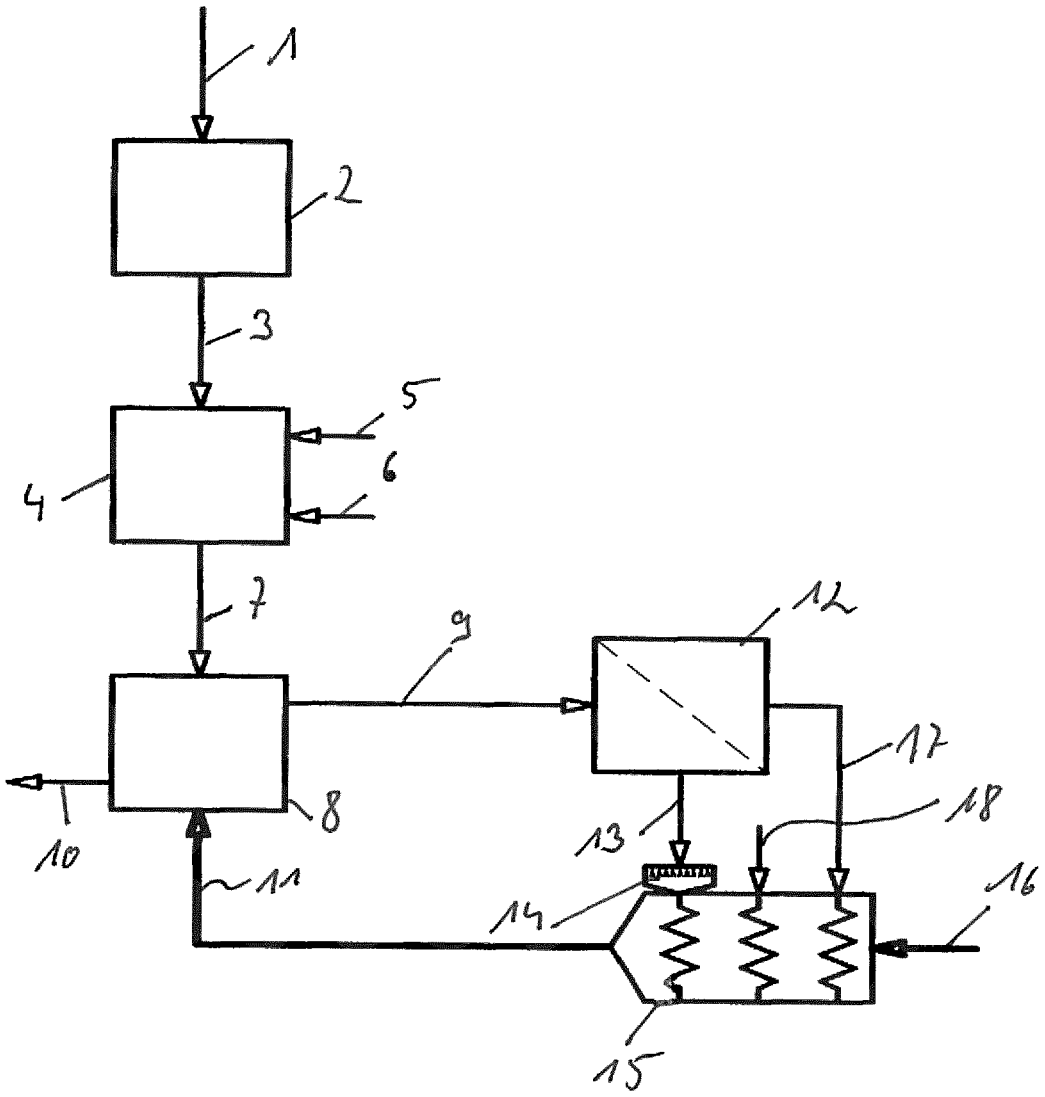
1
2
3
4
5
6
7
8
9
10
11
12
13
14
15
16
17
18

METHOD AND DEVICE FOR REGENERATING FOUNDRY SAND

BACKGROUND OF THE INVENTION

The invention relates to a method for regenerating foundry sand, in particular for the renewed production of foundry molds and/or foundry mold cores from the regenerated foundry sand, through removal of inorganic binding agent, such as, for example water glass or organic binding agent, from a foundry sand/binding agent mixture, using a preferably absorbent and/or adsorbent, solid (i.e. not having a liquid aggregate state, but being formed by a solid body or solid substance, respectively), support means, wherein binding agent and support means are separated from the foundry sand.

The invention further relates to a (regenerating) device for foundry sand, which is embodied for carrying out the proposed regenerating method, comprising means for bringing solid support means and foundry sand into contact.

For economic reasons, the foundry industry strives to reuse foundry sand, i.e. to supply the foundry sand, which has already been used at least once for cores or molds, to a sand cycle. It is known that the foundry sand comprising increasing binder portions (binding agent portions) no longer meets the sand quality demands for a casting process, i.e. one strives to separate the binding agent from the foundry sand as much as possible. Prior to being reused, the foundry sand has to furthermore be pourable, which requires a drying of the sand for the case of a cleaning with water.

A large variety of foundry sand treatment methods have become known, which are very energy-intensive, in particular for the case that they require the use of larger quantities of water or if the regenerating process requires high temperatures.

Reference is thus made for example to DE-OS-18 06 842. The latter describes a thermal method for regenerating foundry sand, wherein, according to the teaching of the publication, the foundry sand is annealed at 1000° C. and binding residues are removed subsequently, namely by means of sudden cool-down, rubbing or smashing and air separation.

DE 199 343 060 007 A1 describes a regenerating method for water glass-bonded foundry sands, which requires a heating of the sand to above 200° C. A similar demand is made in the case of the method known from DE 20 2008 018 001 U1. Here, the foundry sand is treated in a rotary kiln or in a fluidized bed, whereby a screening and air separation can follow.

WO 2013/026 579 A1 describes a mechanical-thermal regenerating method, by means of which the treated foundry sand is to reach new sand-like properties. The sand to be regenerated is thereby initially treated in a pneumatic treatment chamber and is then supplied to a thermal regenerating stage. However, a hardener for water glass is added to the foundry sand prior to the thermal treatment.

DE-OS-24 08 981 describes a mechanical regenerating method, in which foundry sand is radially accelerated at a high speed by means of a centrifugal plate and smashes into a sand cushion. As a result of the sand flow, which falls to the bottom after the impact, an air stream is guided, which is to discharge fine particles, which were created during the impact.

A different mechanical regenerating principle is described in DE 43 16 610 A1.

To date, the purely mechanical and/or thermal regenerating methods do not provide any satisfactory separating results based on the binding agent on an industrial scale.

DE 100 38 419 A1 describes a wet regenerating method, by means of which the sand is regenerated by adding water until the formation of a mushy mass and movement of the mush by means of external forces, rinsing out the sand with water, discharging the water for the neutralization thereof, as well as draining and drying the sand. Good separating results are assumed here, but the large quantities of water required here are unwanted and also dangerous in foundries. In addition, significant energy inputs are required to dry the sand and to evaporate the large quantities of water. The accumulating washing water also has to be regenerated.

A wet regenerating method has also become known from DE 10 2005 029 742 B3, in which one of two partial sand flows is wet-regenerated, which means that the binding agent is rinsed out with the help of large quantities of water and the free liquid is then separated. It is further known from the publication to mix the cleaned foundry sand after being washed with a substance, which absorbs the moisture of the sand grain surface, so as to reduce the energy input for the drying of the cleaned foundry sand. This substance is added in the form of grains, which are larger than the foundry sand grains, so as to separate the substance grains from the cleaned foundry sand by means of screening. According to the teaching of DE 10 2005 029 742 B3, the drying of the cleaned foundry sand thus takes place without heating the latter.

The cleaned and dried foundry sand is mixed with untreated foundry sand, whereby the binding agent portion increases again. The substance grains, which are separated from the cleaned foundry sand, can then be dried. As mentioned, the known method assumes the mixing of the cleaned and dried foundry sand flow with an untreated foundry sand flow, whereby even though the energy input as a whole is low, the sand properties for the foundry operation need to be improved as a result of the binding agent portion, which is still comparatively high. Large quantities of water are furthermore required for the washing process, which precedes the drying process, which has the disadvantages as already described above.

SUMMARY OF THE INVENTION

Based on the above-mentioned prior art, the invention is thus based on the object of specifying an alternative, improved regenerating method for foundry sand, to which binding agent is added from a foundry process, which has already taken place, which, in addition to a low energy consumption, ensures good foundry sand qualities of the regenerated foundry sand, i.e. a high separating quota with respect to the binding agent, and the foundry sand regenerate can furthermore be poured. The produced regenerate (cleaned and dried foundry sand) is to preferably at least largely have new sand properties and/or is to be reusable. More preferably, substances, which are harmful to the environment and/or health, should not have to be used.

The object further lies in specifying a regenerating device for carrying out the advantageous regenerating method.

With regard to the regenerating method, this object is solved by means of the features disclosed herein, i.e. in the case of a generic method in that the support means is brought into contact (not only with the already completely cleaned foundry sand, but) with the foundry sand/binding agent mixture, is preferably added to it, and, together with the binding agent, which adheres thereto and/or which is incorporated therein, is separated from the foundry sand.

With regard to the device, the object is solved by means of the features disclosed herein, i.e. in the case of a generic device in that the latter has separating means for jointly separating the support means and the binding agent, which adheres thereto and/or which is incorporated therein, from the foundry sand.

Advantageous further developments of the invention are specified in the subclaims. All combinations of at least two features, which are disclosed in the description, the claims and/or the FIGURES, fall within the scope of the invention.

To avoid repetitions, features, which are disclosed according to the method, shall also be considered as being disclosed according to the device, and should be capable of being claimed. Features, which are disclosed according to the device, shall likewise also be considered as being disclosed according to the method and shall be capable of being claimed.

The invention is based on the idea of binding the binding agent, which is preferably removed from the foundry sand grains in an upstream mechanical treatment step of the foundry sand/binding agent mixture, to and/or in a solid support means, i.e. not having a liquid aggregate state, and to then separate this solid support means together or jointly with the binding agent, respectively, which adheres thereto and/or which is incorporated therein, including possible additives, which influence the binding behavior of the binding agent, from the foundry sand. Quartz dust, together with the support means, is preferably separated from the foundry sand at the same time, wherein the quartz dust also adheres to the support means and/or is incorporated therein. For the preferred case, which will be described later, that small quantities of an at least temporarily liquid adhesion promotor, in particular of water, are added to the foundry sand/binding agent mixture, the preferably absorbent and/or adsorbent support means simultaneously takes over a drying function in addition to its support function for binding agents. This, however, is not mandatory, in particular if possibly present moisture is discharged in a different way, for example by means of microwave treatment, or if a drying is not necessary as a result of a low moisture content.

It is essential, however, in the case at hand that the solid support means does not or better does not only take over a drying function, but predominantly binds the binding agent, so that binding agent and support means are separated together from the foundry sand, preferably while simultaneously drying the foundry sand, for the purpose of which it is necessary that, in contrast to the teaching of DE 10 2005 029 742 B3, the binding agent is still with the foundry sand at the time of bringing into contact, in particular the addition of the support means, in particular was not separated therefrom in a preceding step by means of a wet treatment of the foundry sand/binding agent mixture for the purpose of washing out the binding agent while simultaneously separating free liquid.

The invention thus utilizes the adhesion properties of the binding agent to a solid support means, which differs from the foundry sand to be cleaned for the first time, in that the support substance binds the majority of the binding agent located with the foundry sand grains and other fine-grained substances, such as quartz dust and/or also electrically charged particles, by means of bringing into contact, in particular adding, the support means with the or to the foundry sand/binding agent mixture, respectively, in particular by means of cohesion and/or adhesion and/or capillary bond and/or other adhesive or suction intake effects, so that support means with binding agent present thereon and/or therein can be separated from the foundry sand, in particular discharged from a gas stream.

The invention hereby overcomes a significant disadvantage of known methods, because binding agents, mechanically abraded fine-grained particles and electrically charged particles cannot be sufficiently separated from the foundry sand with the technologies used there, which had the result that, in the obtained regenerate, they shortened the time period, in which new molds and cores could be produced by means of the regenerate, which had, on principle, been mixed with new sand. The vast majority of the interfering fine-grained particles remained with the foundry sand, they in particular adhered thereto, and, as a result of the increased surface, had an active effect in the wet determination of the electric conductivity and the acid consumption, which serve as indicators for foundry sand properties.

It is preferred, on principle, if the binding agent, which is present in the foundry sand/binding agent mixture and which is to be separated from the foundry sand together with the support means, is an inorganic binding agent, in particular water glass. In addition or in the alternative, organic binding agents can be selected. Support means and binding agents are to at least be adapted to one another or are to be selected, respectively, such that a majority of the binding agent adheres to the support means and/or is incorporated therein, so as to be capable of being separated from the foundry sand, together with the support means, i.e. in a common separating step. In the context of the present disclosure, the binding properties of the actual binding agent active substance, such as, for example additives, which influence water glass, are also understood as belonging to the binding agent. Such additives, which are used in particular in the case of inorganic binding agents or binding agent active substances, respectively, are also offered on the market under the name promoters. These additives preferably influence the network formation of the actual binding active substance and/or the hot strength of the molds and cores, which are to be produced from the foundry sand/binding agent mixture. The above-mentioned additives preferably interact with the binding agent active substance in a physical and/or chemically covalent manner and/or serve as catalyst. Such additives can on principle be added to the foundry sand in powder form and/or in liquid form, in particular together with a liquid binding agent active substance.

As already mentioned, it is essential that the support means is added to the foundry sand/binding agent mixture or is brought into contact therewith, respectively, and not to the already cleaned foundry sand, in order to be able to bind binding agents, possible additives, other fine-grained particles, in particular quartz dust and electrically charged particles. To ensure this, it is advantageous, when the bringing into contact, in particular the adding of support means to the foundry sand/binding agent mixture, takes place without previous wet treatment, i.e. washing out binding agent with liquid, such as water.

It is important to note in general that—unless otherwise specified in the individual case—the % by weight information used in the text is based on the foundry sand/binding agent mixture, thus the original one, which is to be treated in the context of the invention, even prior to an optional mechanical treatment, which will be explained below. This means that substance additions, in particular of the support means and/or of an adhesion promoter, which occur in the course of the method, are disregarded.

It is particularly preferred, when the support means is reused after the separation from the foundry sand, i.e. is added to a (new) old foundry sand batch to carry out the method according to the invention. According to a first alternative, this reuse takes place essentially in an untreated manner, which is possible, in particular, when the absorption capacity for binding agents, possible additives and quartz dust has not been exhausted yet. In the case of an alternative option, the support means can be cleaned of adhering substances prior to the renewed use, for example by mechanical treatment, so that the support means has an increased absorption capacity again for the substances, which are to be incorporated.

It is particularly advantageous when, at the time of being brought into contact with the support means, in particular prior to the addition, the foundry sand/binding agent mixture has a percentage by weight of binding agent weight (percentage by weight of binding agent active substance, such as for example water glass, including possible above-described additives) of at least 0.3% by weight, preferably at least 0.5% by weight, more preferably at least 0.8% by weight, even more preferably at least 1.0% by weight, even more preferably of at least 1.5% by weight, particularly preferably of approximately 2.0% by weight or more.

As already mentioned, the electrical conductivity as well as the acid consumption is used as indicator of the foundry sand quality. On principle, a high acid consumption and a high conductivity thereby allow drawing a conclusion to a high binding agent portion—it is thus the goal of the method according to the invention that the conductivity and/or the acid consumption are/is reduced by means of the method according to the invention or the use of a device according to the invention, respectively.

It is particularly preferred, regardless of the respective used measuring method for determining the conductivity and the acid consumption, when the conductivity value and/or the acid consumption in the case of the method product, i.e. the regenerated foundry sand, is reduced by at least 30% as compared to a corresponding conductivity value or acid consumption value, respectively, of the foundry sand/binding agent mixture prior to a start of the method. It is particularly preferred, when the conductivity value and/or the acid consumption are/is reduced by at least 50% by means of the method, particularly preferably by at least 60%, even more preferably to approximately one-third or less of the corresponding original value prior to the start of the method. This reduction is predominantly based on bringing the foundry sand/binding agent mixture into contact with the support means and an adhesion promoter, if applicable, as well as on the removal of the binding agent or from the binding agent particle by means of the support means.

Typical conductivity values and acid consumption values for three different foundry sand/binding agent mixtures (starting materials of the method) are illustrated in the table shown below, namely prior to the beginning of the method, i.e. in a typical state after a foundry process (left-hand column) as well as after an optional mechanical treatment in the course of the method, wherein the cluster-reg method, which will be explained below, has been used here as mechanical treatment (middle column), wherein, in connection with tests relating to the sand 1 and 2, no mechanical treatment took place and corresponding conductivity and acid consumption values are thus not specified. The values of the regenerated foundry sand are shown in the right-hand column after the method has ended, i.e. after a splitting, which will be explained below, i.e. the separation of the support means with the binding agent.

A binding agent on water glass basis with additives is contained in all foundry sand/binding agent mixtures (sand 1, sand 2, sand 3).

Table relating to the conductivity and acid consumption (examples)

| | 0-sample (old sand, i.e. foundry sand/binding agent mixture prior to the regenerating) | After optional mechanical treatment, in particular clusterreg method | Regenerated sand |
|---|---|---|---|
| Conductivity in μS/cm | (sand 1) 1453 | — | (sand 1) 461 |
| | (sand 2) 1100 | — | (sand 2) 344 |
| | (sand 3) 1138 | 1109 | (sand 3) 450 |
| Acid consumption in mg HCl/100 g sand | (sand 1) 153 | — | (sand 1) 59 |
| | (sand 2) 134 | — | (sand 2) 61 |
| | (sand 3) 130 | 126 | (sand 3) 80 |

As can be gathered from the Table and as shall apply as being disclosed as general teaching, it is preferred, when the conductivity of a corresponding sand sample at the time of being brought into contact with the support means is larger than 800 μS/cm, more preferably larger than 900 μS/cm, even more preferably larger than 1000 μS/cm, even more preferably larger than 1100 μS/cm. It is likewise preferred, when, after concluding the method and the separation of the support means from the sand, which is then regenerated, the conductivity is less than 600 μS/cm, particularly preferably less than 500 μS/cm.

It generally applies for the acid consumption that, prior to carrying out the method, it is preferably larger than 90 mg HCl/100 g sample, particularly preferably larger than 100 mg HCl/100 g sample, even more preferably larger than 110 mg HCl/100 g sample, and/or that the acid consumption of the regenerated sand is less than 90 mg HCl/100 mg sample, particularly preferably less than 80 mg HCl/100 g sample, even more preferably less than 70 mg HCl/100 g sample.

The above-mentioned and other conductivity and acid consumption values reflected as part of this disclosure are determined as follows:

Conductivity:

50 g of sand are added into a closable vessel with 100 ml of distilled or deionized water. Shaking the vessel on the laboratory shaker (reciprocally approx. 200 U/min) for 15 minutes. Then let vessel rest for 15 minutes. Determination of the conductivity with conventional conductivity meters in μS/cm by specifying the temperature in ° C.

Acid Consumption:

100 ml of 0.05 N hydrochloric acid are placed into a plastic bottle (250 ml). A 50 g sand sample is subsequently placed into the bottle and the bottle is closed. This bottle is placed into an ultrasonic bath for 10 minutes. Following the ultrasonic treatment, the sample is shaken for 15 minutes on a platform shaker (reciprocally, 200 U/min). Filtering out takes place subsequently via a filter (tin-coated strip). 50 ml of the filtrate are filtered with a 0.1 N soda lye in an automatic titrator to pH 3.8.

As already suggested above, it is preferred that in particular—but not mandatorily—liquid adhesion promotor for improving the transport of the binding agent to the support means and/or for improving the adhesion of binding agent and/or fine-grained particles and electrically charged particles on and/or the integration of binding agent, fine-grained particles and electrically charged particles in the support means, is added to the foundry sand/binding agent mixture. It is particularly preferred thereby, when a liquid, in particular water, is used as adhesion promotor, or when the adhesion promoter comprises at least one such liquid. In general, the addition of an adhesion promotor in the solid aggregate state is also possible, on principle, whereby it is advantageous for this case, when the adhesion promotor is fluid, at least during a method step, in response to which the adhesion promotor, together with the solid support means, is in contact with the foundry sand/binding agent mixture, thus reaches a liquid aggregate state, which can for example be attained by adding heat, depending on the selection of the adhesion promoter, in particular for the case of adding meltable adhesion promoters.

In particular water is suitable as liquid adhesion promoter. In addition or in the alternative, alcohols, polar solvents, electrically conductive liquids and/or binding agents, in particular liquids, which superficially dissolve and/or dissolve water glass, can be used, for example. As will be explained later, it is essential, however, that the foundry sand/binding agent mixture does not get wet as a result of the adhesion promoter addition, i.e. that a certain maximum moisture content, which will also be explained later, is not exceeded and that in particular no free liquid results, which would need to be separated. Regardless of the quantity and selection of the adhesion promoter, it is preferred to ensure an even distribution or mixing, respectively.

It is also conceivable, on principle, to use non-liquid adhesion promoters or to forego adhesion promoters, which are separate from the support means, in particular when the support means itself takes over this function, in particular as a result of a corresponding interaction with the binding agent, for example as a result of a surface, which is sticky or adhesion-optimized, respectively, for the binding agent, or chemical or physical affinity to the binding agent.

The treatment of the foundry sand/binding agent mixture, which results in the case of liquid or liquefiable (e.g. meltable) adhesion promoters from the (small) adhesion promoter addition and which is only moist, but not wet, then also has the consequentially significant advantages with regard to a small energy input for the drying.

To minimize the treatment energy, in particular the drying energy, it is advantageously provided in further development of the invention, as already specified, to add adhesion promoter, in particular a liquid, preferably water, maximally at a percentage by weight based on the weight of the foundry sand/binding agent mixture without considering the support means weight substrate of less than 4% by weight, preferably less than 3.5% by weight, even more preferably less than 3% by weight, prior to and/or during the joint separation of binding agent and support means from the foundry sand. It is particularly preferred, if this percentage by weight (moisture content) is less than 2.1% by weight, particularly preferably between 0.1% by weight and 2.0% by weight, even more preferably between 0.3% by weight and 2.0% by weight. Reasonable separating results in response to a small drying energy input were also determined with a moisture content of 1.5% (% by weight).

As a whole, it is advantageous, when the moisture content is set such and/or is chosen such during the entire method that the foundry and binding agent mixture as well as the regenerative foundry sand (as well as all intermediate stages) is or remains capable of being poured, respectively, and does not clump at every stage of the method.

As a whole, it is advantages, when a moisture content of the foundry sand/binding agent mixture, which is due to the addition of any kind of liquid whatsoever, without considering the percentage by weight of the support means, in particular during the entire regenerating method, does not exceed a percentage by weight content, which is specified in claim 5 or has percentage by weight ranges specified therein, respectively, and/or is specifically set to such a value.

It turned out to be particularly advantageous, when, preferably prior to the addition of adhesion promotor and/or support means, the foundry sand/binding agent mixture is treated mechanically to remove binding agent, which is aggregated on the foundry sand, and/or to comminute binding agent. On principle, different mechanical treatments can be used here, which ensure that the mixture is subjected to corresponding mechanical stresses, in particular shearing forces and/or impact forces. It is particularly preferred, when the "Clustreg" technology, which is protected with German patent DE 10 2013 001 801 B4, is used, in the case of which the foundry sand/binding agent mixture in the gaps of a pile of damming bodies is treated in a treatment vessel, wherein the pile is set into motion. It is particularly advantageous thereby, when the damming bodies are of a spherical or spheroidal or uneven polyhedral form, and are preferably at least ten times larger than the maximum grain of the foundry sand/binding agent mixture, which is to be treated. It turned out to be particularly advantageous, when at least the outer layer of the damming bodies consists of quartziferous material or when at least the outer layer of the damming bodies consists of polyurethane or similar elastic material and/or when the damming bodies are hollow, so that the moved damming bodies direct the sand flow and stimulate the grains of sand, which touch one another, and when these stimulated grains of sand have a cleaning effect on further grains of sand.

If necessary, binding agent removed from the foundry sand, in particular after an above-mentioned mechanical treatment, can be separated in a particularly preferred manner prior to an adhesion promoter addition, i.e. in a dry manner, for example by screening and/or air separation.

It is possible, on principle, that the support means is bound to a, preferably moved support, for example a, in particular rotating drum and/or a preferably moved, in particular circumferential belt, and that the foundry sand/binding agent mixture is moved relative to the support means, which is bound to the support. In addition or in the alternative, it is possible and preferred to add the support means to the foundry sand/binding agent mixture in the form of a bulk material, wherein the support means is preferably granular and/or powdery and/or fibrous for this purpose. It is important in this preferred case to ensure a good mixing of support means and foundry sand/binding agent mixture, which is preferably moistened (not mandatorily) by adhesion promoter addition.

In particular substances comprising a large active surface, thus large outer surface and/or large inner surface, are suitable as support means (support substance), wherein the latter should be accessible from the outside for interacting with binding agent. The use of known drying agents, such as aluminum oxide, potassium carbonate, potassium hydroxide, silica gel, molecular sieve, celluloids, etc., is possible, on principle, the selection of which should be adapted to the respective binding agent according to substance, grain and/or pore size.

It is simple, cost-efficient and environmentally friendly, to use natural substances, in particular renewable substances, preferably in the form of fibers, in particular also cellulose and/or wood.

Particularly good results were achieved with wood fibers of coniferous wood in a core spectrum of between 0.05 mm and 0.2 mm. The use of coarser or finer wood fibers, which also not necessarily comprise coniferous wood or which have to consist thereof, is also possible, on principle. In tests, they turned out to be particularly absorbent and/or adsorbent and receptive for the fine-grained particles, which are to be removed from the grain mixture. In addition, such wood fibers comprising the adhering fine-grained particles can be split (separated) well from the grains of sand by means of a gas stream, which will be explained later. This is facilitated due to its low weight as compared to the foundry sand and the comparison of the form, which is fiberized with the smooth, round grains of sand. It can be seen microscopically that binding agents and fine-grained particles generally and in particular adhere to the above-mentioned wood fibers with support means and are also stored, i.e. reach into the interior of the support means.

In the case of adding support means, in particular in the form of particles, such as fibers, for example, even more preferably wood fibers, to the foundry sand/binding agent mixture, it turned out to be advantageous, when the percentage by weight of the support means on the foundry sand/binding agent mixture is selected from a value range of between 1% by weight and 15% by weight prior to the addition, even more preferably of between 1% by weight and 10% by weight. Particularly good results were achieved with a percentage by weight of support means, such as, for example wood flour, of more than 2% by weight, particularly preferably more than 3% by weight.

It is particularly advantageous, when the support means, which is used, is combustible, in particular in that it consists of organic material or comprises such organic material. This opens up a further development of the invention, according to which the support means, which is separated from the foundry sand, is combusted and the heat energy and/or directly the combustion phase are used in particular to dry the foundry sand and/or to heat and/or to form a gas stream, which will be explained later, by means of which the separation of support means and foundry sand preferably takes place.

It turned out to be particularly advantageous, when an at least partial treatment, in particular drying, of the foundry sand and/or of the support means takes place, when they are still mixed. This can be realized for example in that a heated gas stream, in particular air stream, which will be explained below and which takes place simultaneously to the separation of support means with binding agent and foundry sand arranged thereon, is applied to the mixture.

It is possible, on principle, to spatially and/or chronologically separate the drying step of the foundry sand and of the support means, from the separating step for jointly separating the support means and the binding agent from the foundry sand, or to carry them out consecutively, respectively. However, it is particularly advantageous to carry out a joint drying and separation, which is achieved in that in particular heated gas, in particular air, flows through the mixture of foundry sand and support means, in particular inside a moving bed, into which the heated gas stream is introduced. This joint drying and splitting (separating) has significant advantages and can alternatively be carried out as an alternative (in batches) or continuously. The support means is discharged by means of the gas stream and can be separated again (outside of a separating unit or container, respectively) with the help of at least one filter or cyclone or in another procedural manner, in particular so as to be combusted, as already suggested. The flow speed of the heated gas stream, in particular air stream, is preferably set such in response to the splitting process that no grains with a diameter of below 0.2 mm, preferably of below 0.1 mm, are still present in the regenerate.

As a result of the low moisture content or of the low moisture addition, respectively, according to the invention, in particular in the form of adhesion promoter, the use of air streams with comparatively low temperature is sufficient, in particular with a temperature below 300° C., for the desired drying and separating step. Particularly advantageously, the temperature of the air stream is less than 250° C. and is particularly preferably selected from a temperature range between 160° C. and 240° C. or is set to such a temperature, respectively. In addition or in the alternative, the foundry sand is maximally heated to a temperature below 220° C., in particular below 200° C., even more preferably below 180° C., in response to the drying step, in particular by means of gas stream application, in particular air stream application, during the separation (splitting) of the support means, together with the binding agent. It has been found, on principle, that the drying time to reach a desired end moisture content decreases as the temperature increases.

The drying step mentioned in the context of the disclosure has an effect in particular in response to the moistening of the foundry sand/binding agent mixture with liquid and/or liquefiable adhesion promoter. If this is forgone, a drying can be foregone, if required.

As already explained, the drying by means of an air stream, in particular of an air stream for simultaneously separating the support means (with binding agent) from the foundry sand, is one option for setting a desired end moisture content. In addition or as an alternative to a mentioned air stream, other drying methods can also be used on principle, such as, for example, a treatment or drying, respectively, with the help of microwaves. A drying can in particular be forgone completely, when the moisture content is kept low from the onset, in particular in that no liquid adhesion promoter is added, but either no adhesion promoter at all or a residue adhesion promoter.

The device according to the invention is intended and designed to carry out the method according to the invention and is characterized by the provision of separating means (separating device) for jointly separating the support means and the binding agent adhering thereto and/or incorporated therein, from the foundry sand. At the same time, the separating means are preferably drying means for the foundry sand and/or the support means, which preferably binds a portion, in particular the majority of the moisture, which is added in particular in the form of adhesion promoter, to itself and/or incorporates it. The separating means preferably comprise a moving bed, in that a gas stream, in particular an air stream, can flow through the foundry sand/binding agent mixture with the binding agent, which adheres to the support means, wherein the gas stream, in particular air stream, can preferably be heated, as disclosed in the course of the method.

It is now particularly advantageous, when, as already mentioned, the support means is combusted as part of the method and/or of the device, wherein the combustion heat is preferably used to heat the gas stream, in particular the air stream, for the drying of the foundry sand and/or the separation of the support means with the binding agent, which adheres thereto and/or which is incorporated therein, for the purpose of which the combustion exhaust gases, for example, are guided across a heat exchanger and/or a heat exchanger is arranged in the combustion chamber and/or around the combustion chamber. In addition or in the alternative, it is conceivable to at least partially form the gas volume stream by means of the combustion gases themselves for the drying of the foundry sand and/or the separation of the support means with the binding agent from the foundry sand.

It is now particularly preferred, when the device compulses a heat recovery system or when heat energy is produced, respectively, in the course of the method from the regenerated foundry sand, which is preferably heated in the gas volume stream as described above, wherein, according to the further development, this heat energy is used to pre-heat the gas volume stream to dry the foundry sand and/or to separate the support means with the binding agent from the foundry sand. So-called sand temperature control systems can be used for this purpose, which comprise for example a heat transfer medium, which flows in a pipe system, and the sand can output heat energy to this pipe system, for example when falling or pouring, respectively, through such a falling or pouring chamber, respectively, which has such a pipe system, and/or by means of fluidizing the sand from below and thus by bringing into contact with such a pipe system. Alternative heat exchanger arrangements can also be used to utilize the heat energy of the regenerated foundry sand.

BRIEF DESCRIPTION OF THE DRAWINGS

Further advantages and details of the invention follow from the description below of a preferred exemplary embodiment by means of the sole FIG. 1, which shows a preferred exemplary embodiment of a method design or device, respectively, according to the invention.

DETAILED DESCRIPTION

FIG. 1 shows a possible embodiment option of a regenerating method according to the invention. An unwashed foundry sand/binding agent mixture, which is to be treated, is added at 1. The present exemplary embodiment is an inorganic binding agent in the form of water glass with promoters. The supply is made into a mechanical treatment system 2, so as to remove binding agents from the foundry sand grains and/or to comminute them by means of the acting mechanical forces. The mechanical treatment preferably takes place in a dry manner, in the concrete exemplary embodiment by means of the "Clustreg" technology or treatment, respectively, described in DE 10 2013 001 801 B4, in the case of which the foundry sand/binding agent mixture is mechanically treated, in particular sheared, by means of a pile and a relatively movement.

The result of the mechanical treatment, i.e. the mechanically treated foundry sand/binding agent mixture, which also contains fine-grained particles, in particular quartz sand particles and electrically charged particles, is transferred to a mixer 4 in 3. If necessary, the filling can be subjected to a screening or air separating step, in particular upstream of the mixer 4, for preferably cleaning the foundry sand/binding agent mixture in a dry manner from a binding agent portion and/or from fine-grained particles. In the specific exemplary embodiment, the addition of adhesion promotor 5, here for example in the form of water and of support means 6, here as an example in the form of wood fibers, takes place in any event in the mixer 4. In the concrete exemplary embodiment, the quantity of water is selected such that the moisture content of the foundry sand/binding agent mixture after a good mixing is 1.7% by weight here as an example, without considering the support means percentage by weight. In response to the mixing, an intensive contact of binding agent particles of the binding agent and support means takes place inside the mixer, whereby the binding agent particles adhere to the support means and/or are incorporated therein.

The further transport of the mixture of foundry sand as well as support means with binding agent particles of the binding agent located therein to a splitter 8 (joint drying and separation) then takes place at 7, in that a drying of the foundry sand as well as at least partially of the support means takes place and the support means, together with the binding agent particle of the binding agent located therein, is discharged at 9, is thus separated from the foundry sand, which is discharged from the splitter in a dry manner at 10. The splitter 8 comprises a moving bed (fluidized bed), in which a gas stream 11, which is heated for example to 180° C. here, flows through foundry sand and support means with binding agent particles of the binding agent located thereon. It can be seen that the discharged support means is supplied to a separator 12, with the help of which support means with binding agent adhering thereto is separated from the discharge stream and is supplied to a combustion system 14 at 13. The exhaust gas is guided through a heat exchanger 15, which heats up a gas stream, here a fresh air stream 16, which then forms the gas stream 11 in the heated state. In addition or in the alternative, the pre-heated air stream 17, which was freed from the support means in the separator 12, is preferably used to heat the fresh air stream 16. In addition or as an alternative to the above-mentioned energy or heat sources, respectively, the external heat energy can be used at 18 to heat the fresh air stream 16, for example electrically, in a gaseous form, with liquid or solid energy sources.

In addition or as an alternative to the heating of the fresh air stream, heat energy can be used (not shown), which is recovered from the regenerated sand, for example by means of a so-called sand temperature control or cooling device, respectively.

LIST OF REFERENCE NUMERALS

1 supply of foundry sand/binding agent mixture
2 mechanical treatment system
3 further transport
4 mixer
5 adhesion promoter
6 support means
7 forwarding
8 splitter for drying and separation
9 discharge (discharge stream comprising support means with binding agent arranged thereon)
10 discharge of cleaned (and optionally dried) foundry sand
11 gas stream
12 separator
13 supplying support means to the combustion system
14 combustion system
15 heat exchanger
16 fresh air stream
17 air stream
18 external heat energy

The invention claimed is:

1. A method for regenerating foundry sand, for the renewed production of foundry molds and/or foundry mold cores from the regenerated foundry sand, through removal of binding agent, from a foundry sand/binding agent mixture, using a solid support means (6), wherein binding agent and support means (6) are separated from the foundry sand, wherein the support means (6) is brought into contact with the foundry sand/binding agent mixture as bulk material and is mixed therewith, wherein the solid support means is absorbent and/or adsorbent, wherein adhesion promotor (5) for improving the transport of the binding agent to the support means (6) and/or for improving the adhesion of the binding agent to and/or the incorporation of the binding agent in the support means (6) is added to the foundry sand/binding agent mixture, wherein the adhesion promoter (5) comprises or is a liquid, or is at least temporarily in liquid form by means of melting, with the simultaneous presence of the support means (6), and wherein the support means (6) together with the binding agent, which adheres thereto and/or which is incorporated therein, is separated from the foundry sand (10).

2. The method according to claim 1, wherein the bringing into contact of support means (6) and foundry sand/binding agent mixture takes place without previously washing out binding agent from the foundry sand/binding agent mixture with liquid.

3. The method according to claim 1, wherein adhesion promoter (5), maximally at a percentage by weight based on the weight of the foundry sand/binding agent mixture of less than 4% by weight, is added prior to and/or during the joint separation of binding agent and support means (6) from the foundry sand, and/or that a moisture content of the foundry sand/binding agent mixture, without considering the percentage by weight of the support means, during the entire regenerating method, has a % by weight value of less than 4% by weight and/or is set to such a % by weight.

4. The method according to claim 1, wherein the foundry sand/binding agent mixture is treated mechanically to remove binding agent from the foundry sand and/or to comminute binding agent.

5. The method according to claim 4, wherein the foundry sand/binding agent mixture is treated mechanically to remove the binding agent from the foundry sand and/or to comminute the binding agent prior to adding adhesion promoter (5) and/or support means, by moving relative to a pile of dust bodies.

6. The method according to claim 1, wherein binding agent removed from the foundry sand after a mechanical treatment and/or prior to an adhesion promoter addition, is separated by screening and/or air separation.

7. The method according to claim 1, wherein the bulk material is granular and/or powdery and/or fibrous.

8. The method according to claim 1, wherein the support means (6), together with the binding agent is separated continuously or in batches, under simultaneous at least partial drying of the support means, which is still mixed with the foundry sand/binding agent mixture, from the foundry sand from binding agent particles, by means of a heated gas stream.

9. The method according to claim 8, wherein the gas stream is heated to a temperature below 300° C. and/or the foundry sand, together with the binding agent, is maximally heated to a temperature below 220° C. during the separation of the support means.

10. The method according to claim 8, wherein the heated gas stream is an air stream in a moving bed.

11. The method according to claim 1, wherein the liquid is water.

* * * * *